United States Patent [19]

Trachtenberg

[11] Patent Number: 4,488,033

[45] Date of Patent: Dec. 11, 1984

[54] HEATER ASSEMBLY FOR HEATING GLASS SURFACE

[75] Inventor: Joseph J. Trachtenberg, New York, N.Y.

[73] Assignee: Interdynamics, Inc., New York, N.Y.

[21] Appl. No.: 496,514

[22] Filed: May 20, 1983

Related U.S. Application Data

[63] Continuation-in-part of Ser. No. 421,848, Sep. 23, 1982.

[51] Int. Cl.[3] ..... F27B 3/06

[52] U.S. Cl. ..... 219/522; 29/621; 219/203; 219/541; 336/331; 156/574

[58] Field of Search ..... 219/203, 522, 541, 542, 219/543, 547; 29/620, 621; 338/331; 156/574

[56] References Cited

U.S. PATENT DOCUMENTS

| | | | |
|---|---|---|---|
| 3,616,122 | 10/1971 | Orcutt | 219/203 X |
| 3,736,404 | 5/1973 | Eisler | 219/203 |
| 3,757,087 | 9/1973 | Bernard | 219/549 |
| 3,918,783 | 11/1975 | Du Rocher et al. | 219/203 X |
| 4,065,848 | 1/1978 | Dery | 29/611 |
| 4,213,028 | 7/1980 | Wolf | 219/203 |
| 4,244,774 | 1/1981 | Dery | 156/574 |
| 4,251,712 | 2/1981 | Parr | 219/203 |
| 4,297,565 | 10/1981 | Parr | 219/522 |

FOREIGN PATENT DOCUMENTS

| | | | |
|---|---|---|---|
| 2017455 | 10/1979 | United Kingdom | 219/203 |
| 1580666 | 10/1980 | United Kingdom | 219/203 |
| 2052224 | 1/1981 | United Kingdom | 219/203 |
| 1598504 | 9/1981 | United Kingdom | 219/203 |

*Primary Examiner*—Volodymyr Y. Mayewsky
*Attorney, Agent, or Firm*—Henry R. Lerner

[57] ABSTRACT

A heater assembly for heating a surface such as the rear window of an automobile. A plurality of heater elements are adhesively secured onto the surface in generally vertically spaced horizontally extending direction. A pair of busbars are adhesively secured onto said surface in generally vertically extending direction overlying the heater elements adjacent the opposite ends thereof. End portions of the heater elements which extend beyond the busbars are wrapped around the busbars and firmly retained by a pair of covering members which are secured in juxtaposed relation to the busbars for providing good electrical contact between the heater elements and the busbars.

13 Claims, 11 Drawing Figures

FIG. 1
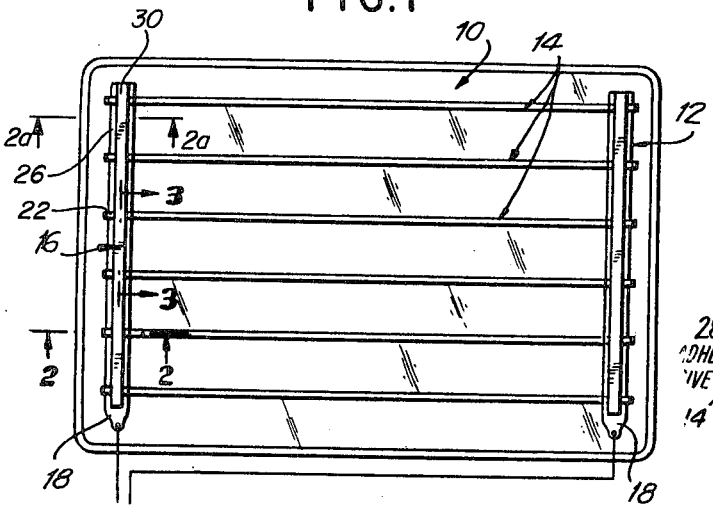
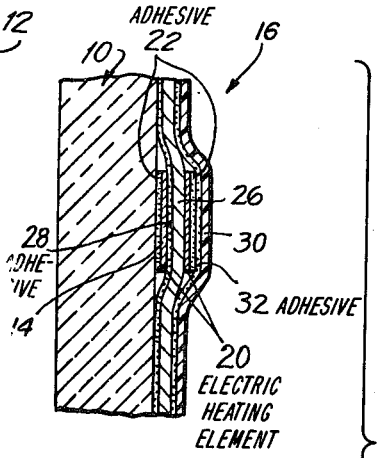
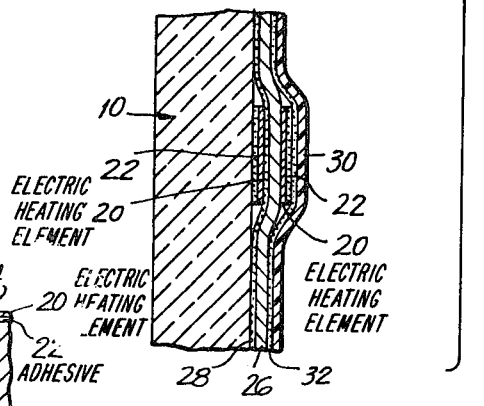
FIG. 3
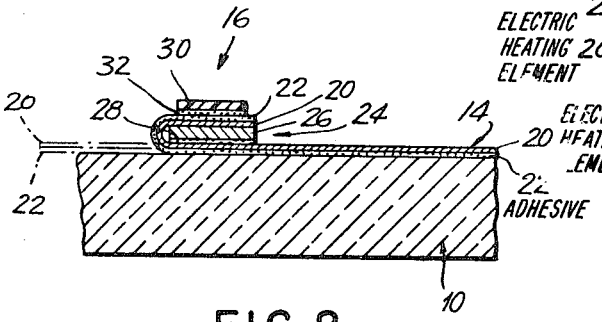
FIG. 2
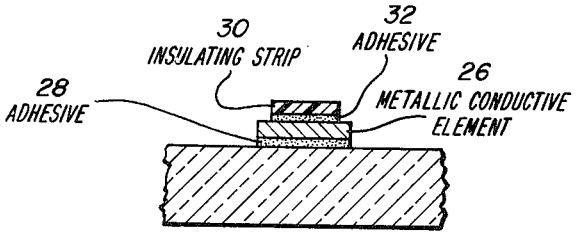
FIG. 2a

FIG.4
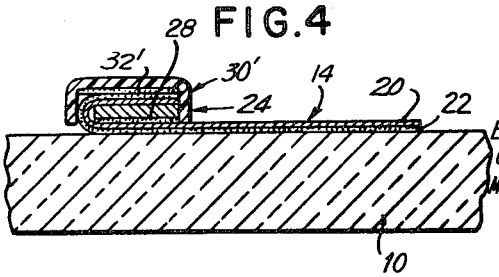
FIG.5
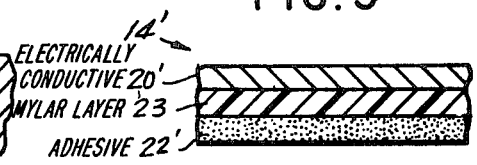
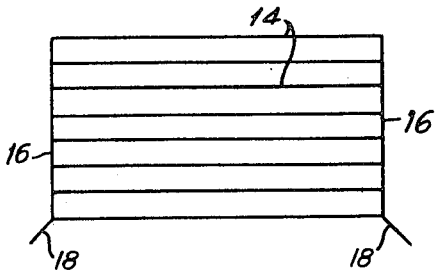
FIG.7
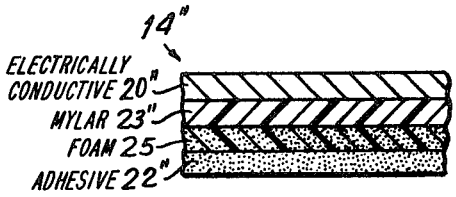
FIG.6
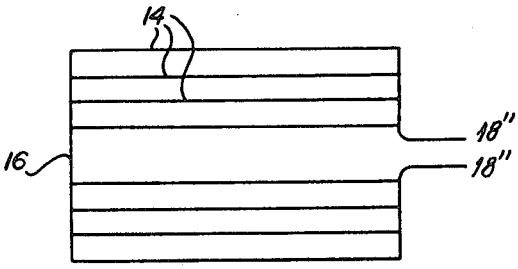
FIG.8

FIG. 9
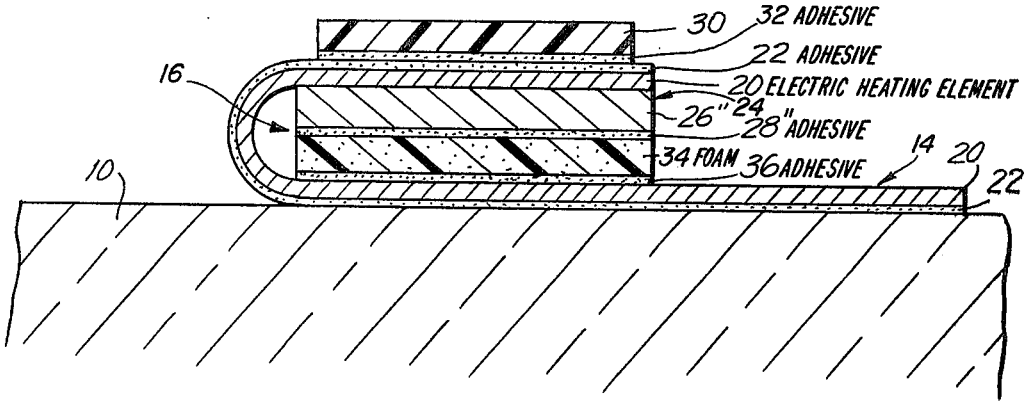
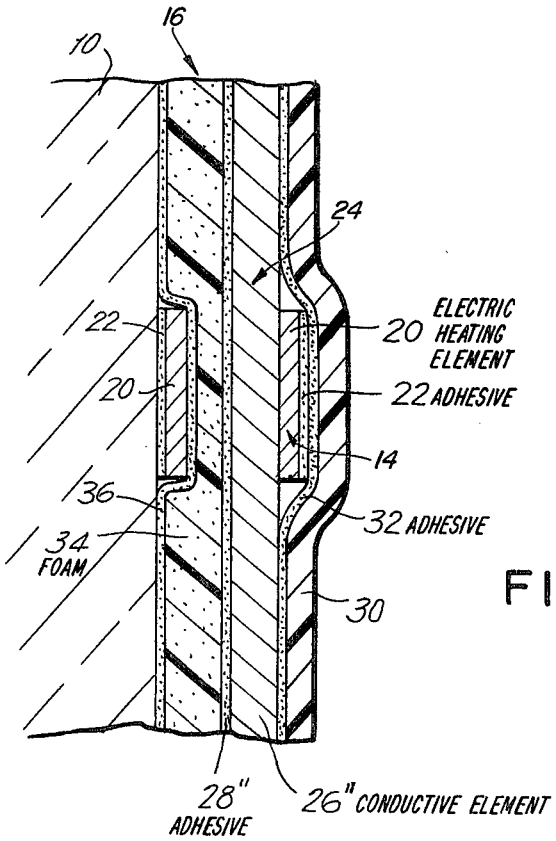
FIG. 10

HEATER ASSEMBLY FOR HEATING GLASS SURFACE

RELATED APPLICATION

This is a continuation-in-part of application Ser. No. 421,848 filed Sept. 23, 1982.

BACKGROUND OF THE INVENTION

The present invention relates to a heater assembly adapted to be secured to a glass surface, and particularly a glass surface defined by a rear window of an automobile so that the heater assembly functions as a defroster and/or defogger to permit unmarred vision therethrough.

Rear window defrosters can be supplied as original equipment in an automobile in which case the heating elements are usually embedded directly within the window glass. The heater assembly involved herein, however, is of the type which is not provided as original equipment with the automobile but which is applied to the rear window of an automobile not equipped with an embedded heater assembly.

U.S. Pat. No. 3,757,087 illustrates a heater assembly consisting of a heating array supported by a backing sheet which enables the array to be secured onto the window, after which the backing sheet is peeled off, leaving only heater elements on the rear window of the automobile. By passing electrical current through the array, there is generated heat which, in turn, causes the defrosting and defogging of the rear window to which the array is secured.

In order to more closely simulate a rear window defroster of the type which is embedded within the glass window as part of the original equipment, it has become desirable to define the heating array by a plurality of parallel spaced horizontally extending narrow heater elements whose opposite ends are electrically connected to a pair of electrical conductive busbars to define a complete electrical circuit for the heater elements. Placing a suitable voltage across the opposite busbars will cause electrical current to flow through the heater elements to provide the necessary heat so that the defroster and defogging function can be performed. An example of such arrangement is shown in U.S. Pat. No. 4,213,028.

In the type of construction described in U.S. Pat. No. 4,213,028, it is of great importance to secure the opposite ends of the heater elements so the busbars in a way which will be simple, which will insure good electrical contact between the heater elements and the busbars, which will maintain good physical securement of the heater elements to the busbars and good securement of the busbars to the rear window. This is attempted in U.S. Pat. No. 4,213,028 by first placing the two busbars in position on the window and thereafter laying the several electrical heating elements across the window with the ends thereof overlapping the busbars. While such arrangement has been satisfactory to some degree, it does require that the installer commit himself to the overall width of the heating array when first placing the busbars in position, before the heater elements are themselves placed on the window. Further, in such arrangement, there is a relatively small portion of the heater element in engagement with the busbar, such portion necessarily being limited to the width of the busbar. Accordingly, both the physical and electrical connections between the heater elements and the busbar are limited in degree.

It is therefore an object of the present invention to provide an improved heater assembly which will enable more secure electrical and physical connections between the ends of the heater elements and the associated busbars.

SUMMARY OF THE INVENTION

In accordance with the invention, the heater elements are first secured onto the rear window, in predetermined parallel spaced relationship and extending for substantially the entire width of the window. Thereafter, with the heater elements already in place, the busbars, each comprising an electrical conductive element backed with an adhesive layer, are placed onto the window, at the desired location, in overlapping relation with the ends of the heater elements, with the adhesive backing of the busbars in firm engagement with the heater elements where they overlie the same, and with said adhesive backing in direct engagement with the glass surface between adjacent heater elements. Thereafter, the heater element end portions which extend beyond the busbars are turned back on themselves and wrapped around the busbars with the conductive part of the heater element in direct engagement with the conductive part of the busbar.

Finally, a cover strip or channel made of an insulating material and backed with an adhesive layer is superimposed onto the busbar to which it is adhesively secured, with the wrapped around end portion of the heater elements firmly held captive between the busbar and the covering strip in solid physical and electrical relation with the busbar. This arrangement provides a far superior physical and electrical connection between the heater elements and busbar than heretofore obtained, and such arrangement is accomplished in a most simplified manner.

BRIEF DESCRIPTION OF THE DRAWINGS

FIG. 1 is a front elevational view of a heater assembly installed on a window of an automobile;

FIG. 2 is a sectional view, on an enlarged scale, taken along line 2—2 of FIG. 1;

FIG. *2a* is a sectional view, on an enlarged scale taken along line *2a*—*2a* of FIG. 1;

FIG. 3 is a sectional view, on an enlarged scale, taken along line 3—3 of FIG. 1;

FIG. 4 is a view similar to FIG. 3, illustrating another embodiment of the invention;

FIG. 5 is a sectional view through a heater element in accordance with another embodiment of the invention;

FIG. 6 is a view similar to FIG. 5, showing yet another embodiment of a heater element;

FIG. 7 is a schematic view of the electrical circuitry of the embodiment of FIG. 1;

FIG. 8 is a schematic view of the electrical circuitry in accordance with another embodiment of the invention; and FIGS. 9 and 10 are views similar to FIGS. 2 and 3, showing another embodiment of the busbar assembly.

Referring now to the drawings, and particularly to FIGS. 1, 2 and 3, there is shown a glass surface 10, typically a rear window of an automobile, provided with a heater assembly 12 in accordance with the invention. The heater assembly 12 consists primarily of a plurality of parallel spaced heater elements 14 adhesively secured to glass surface 10, in parallel spaced relationship, whose opposite free ends are secured to a pair of vertically extending busbar assemblies 16, with which they are in electrically conductive relation. The busbars are provided with a pair of terminals 18 which are adapted to be connected to a power source, via a switch, so that when the switch is on, the elements 14 will be appropriately heated in order to defog and defrost the glass surface to which the heater elements 14 are secured. Where the glass surface is the rear window of an automobile, the heater elements will perform the function of a rear window defroster, permitting vision through the rear window which would otherwise be marred.

Each heating element 14 comprises an electrically conductive narrow strip 20 backed with an adhesive coating 22 which serves to secure the heating element 14 to the glass surface 10. Strips 20 can be applied to the window in any one of a plurality of ways and the particular manner of application does not form part of the subject invention. More specifically, the heating elements 14 can be applied to the window, one at a time, as each is unwound from a single roll. Alternately, two or more heating elements may be supported in predetermined spatial relationship by a backing sheet which is then applied to the glass surface enabling the heater elements to adhere to said surface, after which the backing layer may be peeled off leaving only the heater elements on the glass surface. Such heater elements carrying backing sheet may either be provided with a protective sheet or may be wound into a roll, for storage purposes. Whichever method is utilized, it results in securing onto the glass surface a plurality of heater elements with the adhesive layer 22 against the glass surface and with the electrically conductive strip 20 being exposed.

The invention addresses itself primarily to the manner in which the opposite ends of the heater elements are functionally related to busbar assemblies 16 to define means for providing electric power to the heating elements to enable them to perform the previously described heating function, as will now be described.

The several heating elements 14 are initially secured onto the glass surface in parallel spaced relationship so as to extend over substantially the entire width of the surface 10. The parallel spaced relation may be obtained by use of a marking device or template where the heating elements are put in place one at a time, or may be automatically obtained where such spaced relationship is initially defined by the backing layer which is ultimately peeled off.

Thereafter, a pair of busbars 24, each comprising an electrically conductive element 26 provided with an adhesive layer 28, are placed onto the glass surface, extending in an upward direction, overlying the outer ends of heating elements 14, with adhesive layer 28 on busbar 24 being in engagement with the exposed conductive portion 20 of the heating element, where it overlies the element, and with adhesive surface 28 being directly in engagement with the glass surface inbetween adjacent heating elements to securely adhere busbar 24 onto said glass surface. It will be understood that the location of busbars 24 will define the overall width of the heater assembly 10.

When initially placing the heater elements 14 onto the glass surface the length of each element is selected so that, when placed on the glass surface, the ends thereof extend slightly beyond the expected location of busbars 24, as shown by the dotted lines in FIG. 2. Following the placement of upwardly extending busbars 24 on the glass surface the portion of heater element 14 which extends beyond busbar 24 is turned back on itself and wrapped about the busbar, as shown by the full lines in FIG. 2 whereby the conductive portion 20 comes into surface to surface engagement with electrically conductive portion 26 of busbar 24, at the same time leaving adhesive coating 22 exposed.

Finally, after the opposite ends of each heater element have been wrapped about their busbars 24, there is provided for each busbar a longitudinally covering strip 30 made of plastic or other insulating material, substantially coextensive with busbar 26, and provided on its undersurface with an adhesive layer 32 for retaining the wrapped around portion of heater element 14 in place, whereby good electrical contact is obtained and maintained between electrically conductive portion 20 of the heater element and electrically conductive busbar portion 26. It will also be noted that adhesive layer 32 of covering strip 30 is in surface to surface contact with busbar 24 throughout its entire extent, except only where such surface is in contact with adhesive layer 22 of the heater elements. Thus, it is seen that busbar 24 is firmly secured by its adhesive layer 28 to the glass surface and that covering strip 30 is, in turn, firmly secured to busbar 24 by means of its adhesive element 32.

It will thus be seen that in accordance with the above description, a simple way is provided for establishing a firm bonding of the heater elements to the busbars in a way which provides excellent and permanent electrical conductivity between the busbars and the heater elements. More specifically, by wrapping the ends of the heating elements about the busbars there is provided a more secure physical and electrical connection than previously available. Furthermore, because of the wrap around feature, the heater elements may be placed on the glass surface without being initially concerned about the busbars since these are not placed on the window until after the heater elements are placed thereon.

FIG. 4 illustrates a slightly modified version of the invention. In accordance with this embodiment, the heater element 20 and busbars 24 are identical in form and are applied exactly in the same manner as discussed in connection with FIGS. 1 to 3. Instead of the covering strip 30, however, there is provided a covering channel 30' which receives the busbar 24 and the portion of the heater element 20 wrapped about the busbar so as to fully encase these elements, thus providing a more finished appearance to the entire assembly, more nearly simulating a rear window defroster of the type originally provided as original equipment on automobiles by the manufacturer. Covering channel 30' is provided with an adhesive layer 32' which performs exactly the same function as the adhesive layer 32 in the embodiment of FIGS. 1 to 3. In accordance with this embodiment, none of the adhesive layers forming part of the assembly are exposed, all of these being fully contained within covering channel 30'. In all other respects, however, the embodiment of FIG. 4 is identical to that of FIGS. 1 to 3.

FIG. 5 illustrates another embodiment of the heater element used in accordance with the invention. More specifically, in accordance with this embodiment, heater element 14' comprises electrically conductive portion 20', adhesive coating 22', and a Mylar intermediate layer 23 to impart to the heater element more body and thus facilitate its handling and increasing its strength.

FIG. 6 is yet another embodiment of the heater element 14'' in which there is provided electrically conductive portion 20'', adhesive coating 22'', Mylar intermediate layer 23'', and foam layer 25. This embodiment imparts to the heating element even greater body and ease of handling than the embodiment of FIG. 5.

Both of the embodiments of FIGS. 5 and 6 are utilized precisely in the same manner as the heater element illustrated and described in connection with FIGS. 1 to 3.

In the embodiment of FIG. 1, all the heater elements 14 are in electrical parallel relationship with respect to the busbar assembly 16, such being shown schematically in FIG. 7. It will be understood, however, that instead of having two continuous busbars interconnected to the opposite ends of the heater elements, as in FIG. 7, one of the busbars could be interrupted as shown in FIG. 8 in which event electrical terminals for the heating array is provided at the points where the busbar is interrupted, identified by the reference numeral 18''—18'', providing in this manner a parallel series arrangement for the respective heater elements. In all other respects, however, the manner in which the heater elements are wrapped around and electrically connected to the busbar is identical to that described in connection with the embodiments of FIGS. 1 to 3.

FIGS. 9 and 10 illustrate another embodiment of the busbar assembly in accordance with the invention. More specifically, FIGS. 9 and 10 are views substantially similar to FIGS. 2 and 3, respectively, the sole difference being in that electrically conductive element 26'' is backed with a foam layer 34 secured thereto by adhesive layer 28'', with the opposite side of foam layer 34 being provided with adhesive layer 36 for securement to the glass surface. The use of the foam layer backing 34 is for the purpose of achieving a more uniform bonding onto the glass surface. Such greater uniformity can be achieved because pressure can be applied by the installer, forcing the foam layer against the glass surface to make certain that there is complete surface to surface contact between the foam and the glass surface. This eliminates possible discontinuities which are more likely to exist in the embodiment of FIGS. 2 and 3 where metallic conductive element 26 is directly adhered onto the glass surface by means of the adhesive layer 28. Furthermore, as best seen in FIG. 3, heating elements 14 lie under conductive element 26 forcing the latter to go around the heating elements, whereby use of the foam backing permits pressure to be applied onto the foam surface immediately adjacent the underlying heating elements for better bonding. Finally, the foam layer 34 acts as a shock absorber thus reducing the possibility that conductive element 26'' will be detached from the glass surface.

In a similar manner as that described in connection with FIGS. 9 and 10, longitudinally covering strip 30 in FIGS. 2 and 3, and covering channel 30' in FIG. 4 may be provided with a foam layer for achieving a more uniform bonding of the covering strip and channel onto the underlying busbar 24.

While there is herein shown and described the preferred embodiments of the invention, it will be understood that the invention may be embodied otherwise than as herein specifically illustrated or described, and that in the illustrated embodiments certain changes in the details of construction and in the form and arrangement of parts may be made without departing from the underlying idea or principles of this invention within the scope of the appended claims.

Having thus described my invention, what I claim and desire to secure by Letters Patent is:

1. A heater assembly secured to a glass surface to be heated comprising:

(a) a plurality of heater elements each defined by an electrically conductive narrow strip backed with an adhesive coating secured by said adhesive coatings onto a glass surface in generally vertically spaced horizontally extending direction, (b) a pair of busbars, each defined by an electrically conductive bar backed with an adhèsive coating, secured by said adhesive coating onto said surface in generally vertically extending direction, one of said busbars overlying said heater elements adjacent the ends of said heater elements at one side of said surface and the other of said busbars overlying said heater elements adjacent the ends of said heater elements at the opposite side of said surface, whereby the adhesive coating on each electrically conductive bar is in engagement with the heater elements and with the glass surface intermediate said heater elements, said busbars being positioned so that the end portions of said heater elements extend beyond said busbars, (c) said end portions of said heater elements being turned about themselves and wrapped around said busbars with the electrically conductive strip of said heater elements being in electrical engagement with the surface of the electrically conductive bar about which said end portions are wrapped, and (d) a pair of covering members made of an electrically insulating material, each provided with an adhesive coating, juxtaposedly secured by said adhesive coating onto said busbars, respectively, for substantially the entire extent of said busbars, thereby retaining the wrapped around end portions of said heater elements between the busbars and the covering members.

2. A heater assembly in accordance with claim 1, wherein said covering members are channel shaped so as to fully contain said busbars therein.

3. A heater assembly in accordance with claim 1, wherein means are provided for applying a voltage across said pair of busbars.

4. A heater assembly in accordance with claim 1, wherein one of said busbars is interrupted between adjacent heater elements and wherein means are provided for applying a voltage across the points of interruption of said busbar.

5. A heater assembly in accordance with claim 1, wherein said glass surface is the rear window of an automobile.

6. A heater assembly in accordance with claim 1, wherein said conductive bar is backed by a foam layer to enable better bonding of the busbars onto said surface.

7. A heater assembly in accordance with claim 6, wherein said covering members are made of an electrically insulating material.

8. A heater assembly in accordance with claim 6, wherein said covering members are channel shaped so as to fully contain said busbars therein.

9. A method of applying a heater assembly to a glass surface to be heated comprising the steps of, (a) securing a plurality of heater elements, each defined by an electrically conductive narrow strip backed by an adhesive coating, onto said surface in generally vertically spaced horizontally extending direction, with the adhesive coating in contact with said surface, and securing the strip to said surface, (b) securing a pair of busbars, each defined by an electrically conductive bar backed with an adhesive coating, onto said surface in generally vertically extending direction with one of said busbars overlying said heater elements adjacent the ends thereof at one side of said surface and the other of said busbars overlying said heater elements adjacent the ends thereof at the opposite side of said surface, whereby the adhesive coating on each electrically conductive bar is in engagement with the heater elements and with the glass surface intermediate said heater elements to secure the busbars thereto, and said busbars being positioned so that the end portions of said heater elements extend beyond said busbars, (c) turning said end portions of said heater elements about themselves and wrapping them about said busbars with the electrically conductive strip of said heater elements being in electrical engagement with the electrically conductive bar about which said end portions are wrapped, and (d) securing a pair of covering members made of an electrically insulating material, each provided with an adhesive coating, by said adhesive coating onto said busbars in juxtaposition therewith for substantially the entire extent of said busbars, thereby retaining said wrapped around end portions of said heater elements between the busbars and the covering members.

10. A method in accordance with claim 9, wherein said covering members are channel shaped so as to fully contain said busbars therein.

11. A method in accordance with claim 9, wherein one of said busbars is interrupted between adjacent heater elements.

12. A method in accordance with claim 9, wherein said conductive bar is backed by a foam layer to enable better bonding of the busbars onto said surface.

13. A method in accordance with claim 12, wherein said covering members are made of an electrically insulating material.

* * * * *